US011111664B2

(12) United States Patent
Kurosawa

(10) Patent No.: US 11,111,664 B2
(45) Date of Patent: Sep. 7, 2021

(54) METHOD OF INTRODUCING PRESTRESS TO BEAM-COLUMN JOINT IN TRIAXIAL COMPRESSION

(71) Applicant: KUROSAWA CONSTRUCTION CO., LTD., Chofu (JP)

(72) Inventor: Ryohei Kurosawa, Tokyo (JP)

(73) Assignee: KUROSAWA CONSTRUCTION CO., LTD., Chofu (JP)

( * ) Notice: Subject to any disclaimer, the term of this patent is extended or adjusted under 35 U.S.C. 154(b) by 0 days.

(21) Appl. No.: 16/897,267

(22) Filed: Jun. 10, 2020

(65) Prior Publication Data

US 2021/0079643 A1 Mar. 18, 2021

(30) Foreign Application Priority Data

Sep. 13, 2019 (JP) ..... JP2019-167793

(51) Int. Cl.
*E04B 1/22* (2006.01)
*E04B 1/98* (2006.01)
(Continued)

(52) U.S. Cl.
CPC ..... *E04B 1/22* (2013.01); *E04B 1/98* (2013.01); *E04C 3/34* (2013.01); *E04H 9/021* (2013.01); *E04H 9/025* (2013.01)

(58) Field of Classification Search
CPC ... E04B 1/22; E04B 1/98; E04H 9/025; E04H 12/16; E04C 3/26; E04C 3/34
See application file for complete search history.

(56) References Cited

U.S. PATENT DOCUMENTS 2,786,349 A * 3/1957 Cuff ..... E04B 1/22 52/223.4
6,920,728 B2 * 7/2005 Powers ..... E04B 1/22 52/236.5

(Continued)

FOREIGN PATENT DOCUMENTS

JP 2005-023603 A 1/2005
JP 4041828 B2 2/2008

(Continued)

*Primary Examiner* — Andrew J Triggs
(74) *Attorney, Agent, or Firm* — SGPatents PLLC

(57) ABSTRACT

There is provided a method of prestressing a beam-column joint with an appropriate ratio among the magnitudes of compression in the directions of X, Y, and Z axes. The method introduces prestress in a beam-column joint with a tensile introducing force generated by tensionally anchoring prestressing tendons that are arranged in PC beams extending along two horizontal directions (or X axis and Y axis) and PC columns extending along the vertical direction (or Z axis) and passed through the beam-column joint to bring the beam-column joint in triaxial compression, the prestress being introduced such that a diagonal tensile force T generated by an input shear force due to a seismic load of an extremely great earthquake that may occur very rarely will be cancelled completely or partially so as not to allow diagonal cracks to occur. The ratio of the prestresses introduced in the directions of the respective axes satisfies the following equation (1):

$$\sigma x:\sigma y:\sigma z=1:1:0.3\text{–}0.9 \quad (1)$$

where σx, σy, and σz are prestresses introduced in the directions of the X axis, the Y axis, and the Z axis respectively.

6 Claims, 5 Drawing Sheets

(51) Int. Cl.
*E04H 9/02* (2006.01)
*E04C 3/34* (2006.01)

(56) References Cited

U.S. PATENT DOCUMENTS

| | | | | |
|---|---|---|---|---|
| 9,534,411 | B2 * | 1/2017 | Kurosawa | E04B 1/98 |
| 9,765,521 | B1 * | 9/2017 | Abbas | E04B 1/22 |
| 9,921,188 | B2 * | 3/2018 | Takamine | G01M 5/0033 |
| 10,378,197 | B2 * | 8/2019 | Kurosawa | E04B 5/29 |
| 10,465,374 | B2 * | 11/2019 | Sugaya | E04C 5/06 |
| 2015/0330095 | A1 * | 11/2015 | Kurosawa | E04H 9/02 52/741.3 |
| 2016/0084803 | A1 * | 3/2016 | Takamine | G01N 29/4427 73/587 |
| 2017/0356177 | A1 * | 12/2017 | Lee | E04B 1/215 |
| 2018/0127966 | A1 * | 5/2018 | Kurosawa | E04B 1/30 |
| 2021/0079643 | A1 * | 3/2021 | Kurosawa | E04C 5/12 |

FOREIGN PATENT DOCUMENTS

| | | | |
|---|---|---|---|
| JP | 5612231 | B1 | 10/2014 |
| JP | 6644324 | B1 | 2/2020 |

* cited by examiner

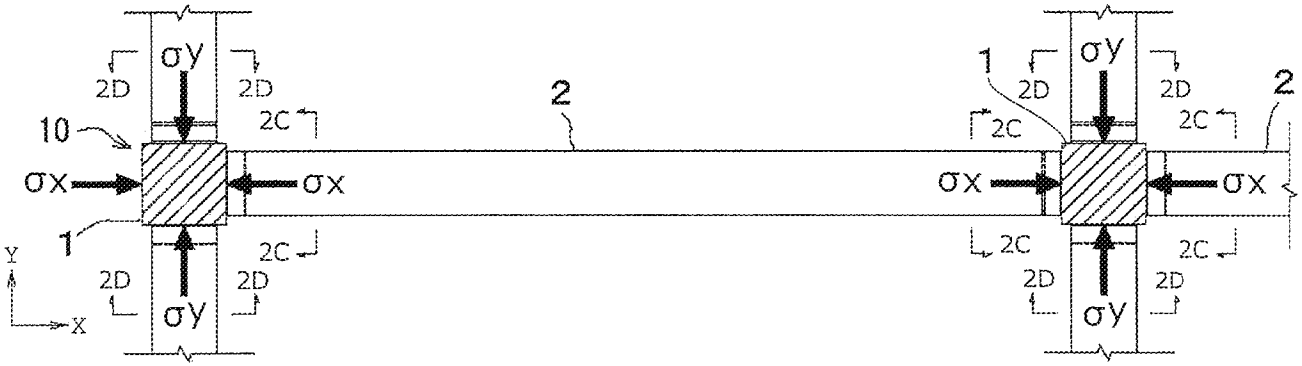
Fig.2A
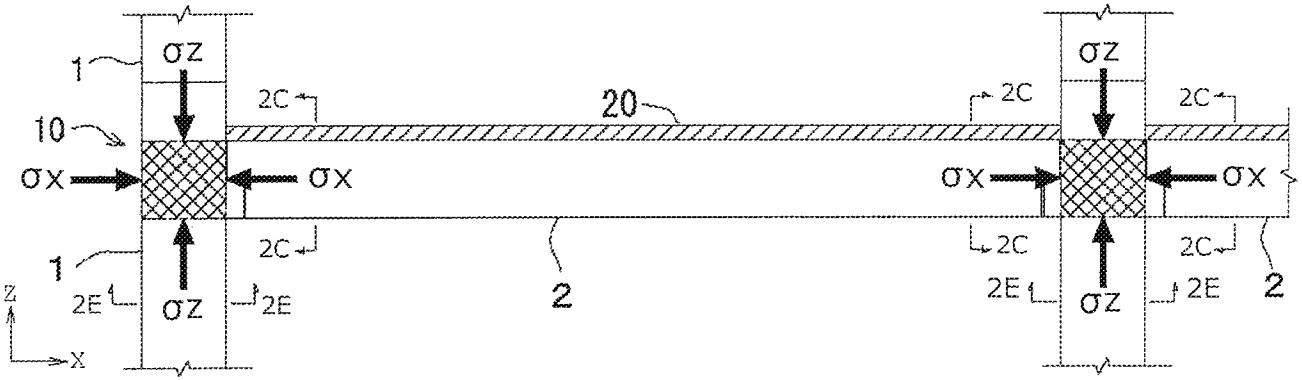
Fig.2B
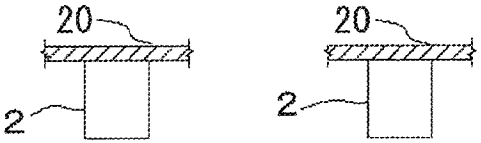
Fig.2C
Fig.2D
Fig.2E

METHOD OF INTRODUCING PRESTRESS TO BEAM-COLUMN JOINT IN TRIAXIAL COMPRESSION

Priority is claimed on Japanese Patent Application No. 2019-167793 filed on Sep. 13, 2019, the content of which is incorporated herein by reference.

TECHNICAL FIELD

The present invention relates to a method of introducing prestress into a beam-column joint (or column-beam joint) of a prestressed concrete structure (PC structure) to establish triaxial compression.

BACKGROUND ART

It is demonstrated by many studies in the past that a beam-column joint formed by concrete members extending in three axial directions (i.e. beams extending in two horizontal directions x and y and columns extending in the vertical direction z) may develop diagonal shear cracks caused by a diagonal tensile force. Such cracks of the concrete members thus damaged develop further to cause brittle fractures without toughness. Such breaking of the beam-column joint directly leads to collapse of the structural frame, eventually resulting in fatal shear fractures of the entire structure.

Patent literatures in the citation list below disclose various methods of reinforcing beam-column joints in order to prevent diagonal cracks from occurring in them.

Patent Literature 1 (Japanese Patent Application Laid-Open No. 2005-23603) discloses a reinforcing method for a beam-column joint of a reinforced concrete structure (RC structure). According to Patent Literature 1 (JP2005-23603), in a beam-column joint of a concrete structure, the upper beam main reinforcing bars extending from the end face of each beam into the beam-column joint extend obliquely downward toward the end face of the opposed other beam, further extend horizontally into the opposed other beam from the end face thereof, and are fixed to constitute the lower beam main reinforcing bars of the opposed other beam, and the lower beam main reinforcing bars extending from the end face of each beam into the beam-column joint extend obliquely upward toward the end face of the opposed other beam, further extend horizontally into the opposed other beam from the end face thereof, and are fixed to constitute the lower beam main reinforcement bars of the opposed other beam. This arrangement reduces the tensile principal stress and increases the compressive principal stress.

Patent Literature 2 (U.S. Pat. No. 9,534,411) discloses a two-stage nonlinear resilient aseismatic design for a PC structure in which precast concrete members constituting columns and beams are connected together by pressure connection (or binding juncture) achieved by secondary cables that pass through a panel zone (i.e. beam-column joint). In this two-stage nonlinear resilient aseismatic design, the beam-column joint in pressure connection is kept in a prestressed joint state against seismic loads below a design limit. When a great seismic load exceeding the design limit acts on it, the beam-column joint is brought into a partially prestressed joint state to prevent fatal damages of the main structural members (i.e. columns, beams, and panel zone) from occurring.

CITATION LIST

Patent Literature

Patent Literature 1: Japanese Patent Application Laid-Open No. 2005-23603

Patent Literature 2: Japanese Patent No. 5612231 that corresponds to U.S. Pat. No. 9,534,411

Patent Literature 3: Japanese Patent No. 4041828

SUMMARY OF INVENTION

Technical Problem

In the structure disclosed in Patent Literature 1 (JP2005-23603), main reinforcing bars are arranged to extend obliquely from the end face of one beam in the beam-column joint and fixed to the end face of the other beam to thereby reduce the tensile principal stress.

However, as is well known, the reinforcing bars cannot prevent cracking of an RC structure from occurring. The role of the reinforcing bars is to prevent or reduce development of cracks after the occurrence thereof to prevent enlargement of the crack width. In other words, the reinforcing bars cannot proactively prevent the occurrence of cracks but merely prevent or reduce the development of cracks only after their occurrence.

Therefore, even if the reinforcing bars are arranged in the manner disclosed in Patent Literature 1 (JP2005-23603), it is not possible to proactively prevent the diagonal cracks in the beam-column joint from occurring. In other words, what is disclosed in Patent Literature 1 (JP2005-23603) is prevention or reduction of development of cracks merely reactive to their occurrence. Therefore, this structure cannot prevent deterioration in the resistance against earthquakes or the durability of the beam-column joint due to the occurrence of diagonal cracks, if seismic loads act on the beam-column joint repeatedly.

Other problems with the structure disclosed in Patent Literature 1 (JP2005-23603) are that the number and the diameter of the upper beam main reinforcing bars on the end face of one beam and the number and the diameter of the lower beam main reinforcing bars on the end face of the other beam are not necessarily equal to each other and that bending and obliquely arranging the reinforcing bars take much effort. Moreover, the arrangement of the reinforcing bars in the beam-column joint is complicated, and they do not fit in the beam-column joint neatly. This can lead to uneven pouring of concrete, likely resulting in the occurrence of honeycombs due to unsatisfactory pouring.

The following descriptions are found in Patent Literature 2 (U.S. Pat. No. 9,534,411):

"At a panel zone (a column-beam junction), a prestress is applied to a great beam, which is a beam in a span direction, a girder beam, which is a beam in a longitudinal direction, and the column. Thereby the panel zone receives a prestress force three-dimensionally in all directions of X, Y, and Z."

"Axial compressions are added three-dimensionally to the panel zone, which thereby has a restoration force characteristic by the prestress. This prevents residual deformation after the earthquakes perfectly. This is a completely different design idea from that of the related art, in which the destruction of the panel zone in the RC construction and the PC construction absorbs energy."

Based on this design principle, prestress is introduced in a beam-column joint in three axial directions to proactively cancel diagonal tensile forces acting in the beam-column joint by earthquakes. In consequence, diagonal tensile forces will not be generated, and shear fractures will be prevented completely. This eliminates the need for many diagonal reinforcing bars like those described in Patent Literature 1 (JP2005-23603), thereby solving the problem of honeycombs of concrete in the beam-column joint (or panel zone).

While Patent Literature 2 (U.S. Pat. No. 9,534,411) describes a design principle of a beam-column joint (or panel zone) in triaxial compression, it does not describe a specific way of introducing prestress in three axial directions, namely the ratio of prestresses to be introduced in the three axial directions respectively and the upper limit of the prestress to be introduced.

Generally speaking, while the working load on a beam generates little axial force in it, the working load on a column always generates an axial force in it. The direction of the axial force is not constant but varies depending on the type of the working load. While the axial force generated by the stationary load (vertical load) is compressive force, axial forces generated by accidental loads (horizontal loads) due to earthquakes, winds, etc. include compressive forces and tensile forces. Strong tensile or compressive forces tend to be generated in outer columns arranged on the outer circumference of buildings and corner columns by seismic loads.

The magnitude of the axial force in columns varies depending on the floor level. In tall buildings and extremely tall buildings, the difference in the axial force in columns is very large between the top floor and the bottom floor, and the magnitude and direction (compressive or tensile) of axial forces generated in columns by working loads are not uniform but vary.

The present invention has an object to further develop the design principle of applying three-dimensional axial compression to a beam-column joint (or panel zone) and provide a method of applying prestress to achieve triaxial compression of a PC structure in an appropriate ratio.

Solution to Problem

According to the present invention, there is provided a method of introducing prestress in a beam-column joint that introduces prestress in a beam-column joint in a multi-story building structure constructed by PC columns and PC beams with a tensile introducing force generated by tensionally anchoring prestressing tendons that are arranged in PC beams extending along two horizontal directions (or X axis and Y axis) and PC columns extending along the vertical direction (or Z axis) and passed through the beam-column joint to bring the beam-column joint in triaxial compression, the prestress being introduced such that a diagonal tensile force generated by an input shear force due to a seismic load of an extremely great earthquake that may occur very rarely will be cancelled completely or partially so as not to allow diagonal cracks to occur, wherein the ratio of the prestresses introduced in the directions of the respective axes satisfies the following equation (1):

$$\sigma x:\sigma y:\sigma z=1:1:0.3\text{-}0.9 \quad (1)$$

where σx, σy, and σz are prestresses introduced in the directions of the X axis, the Y axis, and the Z axis respectively, which are calculated by the following equations:

$$\sigma x=Px/Ax,\ \sigma y=Py/Ay,\ \sigma z=Pz/Az,$$

where Px is the tension introducing force in the direction of the X axis, Ax is the cross sectional area of the beam at its end with respect to the direction of the X axis, Py is the tension introducing force in the direction of the Y axis, Ay is the cross sectional area of the beam at its end with respect to the direction of the Y axis, Pz is the tension introducing force in the direction of the Z axis, and Az is the cross sectional area of the column at its end with respect to the direction of the Z axis.

In the method of introducing prestress in a beam-column joint, the values of σx, σy, and σz may fall within the following ranges:

$2.0 \le \sigma x \le 10.0$ (N/mm$^2$)

$2.0 \le \sigma y \le 10.0$ (N/mm$^2$)

$0.6 \le \sigma z \le 9.0$ (N/mm$^2$)

In the method of introducing prestress in a beam-column joint, at least five layers of the building structure may be grouped, and the prestress σz introduced in PC columns in the layers of the same group may be uniformized.

In the method of introducing prestress in a beam-column joint, the prestress may be introduced such that when a diagonal tensile force generated in the beam-column joint by an extremely great earthquake is partly cancelled and partly remains, the tensile stress intensity resulting from the remaining diagonal tensile force will be equal to or lower than the allowable tensile stress of the concrete in the beam-column joint.

Advantageous Effects of the Invention

Advantageous effects of the present invention are as follows.

(1) As above, prestresses are introduced in three axial directions in a ratio specified by equation (1), where the prestress introduced in the columns is decreased taking into consideration variations in the axial force acting on the columns. This makes the ratio of the compressive stress intensities acting on the beam-column joint in three axial directions substantially equal to 1:1:1. The compressive stress intensities of this ratio generate a resultant compressive stress on a diagonal of the beam-column joint at an ideal angle of 45 degrees approximately. This compressive stress can completely or nearly completely cancel a diagonal tensile force that will be generated on a diagonal of the beam-column joint by an input shear force acting on the beam-column joint by a seismic load, thereby preventing diagonal cracks leading to shear failure from occurring with reliability. Moreover, since the prestress introduced in the columns is lower than the prestress introduced in the beams, the axial force acting on the columns is controlled within an allowable stress intensity range even under the stationary load (vertical load). This prevents the compressive stress intensity from becoming unduly high.

(2) The values of σxand σy mentioned in equation (1) may by limited within the range between 2.0 and 10.0 N/mm$^2$. Then, the value of σz is limited within the range between 0.6 and 9.0 N/mm$^2$ according to the ratio specified by equation (1). The above ranges are set based on the design standard strength Fc of concretes that are commonly used in PC structures (Fc=40N/mm$^2$–60N/mm$^2$). This does not require excessively low or excessively high stress introducing forces and allows reasonable and cost-effective designs.

(3) While the axial force acting on columns varies depending on the floor level or the location in a horizontal plane, the prestress introduced in the columns in at least five layers (or stories) of a building may be uniformized. This allows the differences in the axial forces acting on the columns in the five layers to be adjusted by the range of ratio according to equation (1) (σz=0.3–0.9) to control the axial forces acting on the columns within an allowable range. This allows efficient designs and constructions and eliminates errors in tensioning during construction.

(4) There may be cases where a diagonal tensile force generated in a beam-column joint by an extremely great earthquake is partly cancelled by the prestress introduced therein and partly remains. If the prestress is introduced such that a tensile stress intensity resulting from the diagonal tensile force will not exceed the allowable tensile stress intensity of the concrete used to construct the beam-column joint even in such cases, diagonal shear cracks fatal to the building structure will not occur. This ensures aseismatic performance of the building.

(5) The method of introducing prestress according to the present invention is based on a principle that is completely different from conventional RC structures, in which reinforcing bars are provided in a beam-column joint in order to reactively prevent development of cracks after they occur. The method of introducing prestress according to the present invention brings a beam-column joint in triaxial compression with a most reasonable balance that is set taking into consideration factors leading to variations in the axial forces acting on the columns. This proactively cancels tensile forces that may cause cracks to reliably prevent cracks from occurring.

BRIEF DESCRIPTION OF DRAWINGS

FIG. 1A is a plan view and FIG. 1B is a side view.

FIGS. 2A to 2E illustrate beam-column joints in triaxial compression according to the present invention. FIG. 2A is a plan view; FIG. 2B is a side view; FIG. 2C is an 2C-2C cross sectional view of the beam shown in FIGS. 2A and 2B; FIG. 2D is a 2D-2D cross sectional view of the beam shown in FIG. 2A; and FIG. 2E is a 2E-2E cross sectional view of the column shown FIG. 2B.

FIG. 5A is a plan view, FIG. 5B is a side view, and FIG. 5C is a cross sectional view of a beam.

Embodiments for Carrying Out the Invention

Figure 1A:
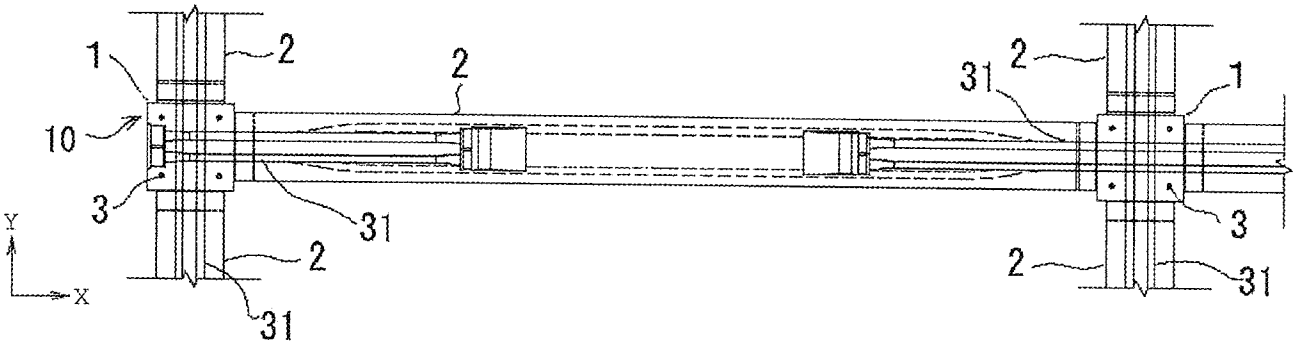
FIGS. 1A and 1B show a portion of a middle floor of a building including beam-column joints constructed only by PC members according to the present invention.
Figure 1B:
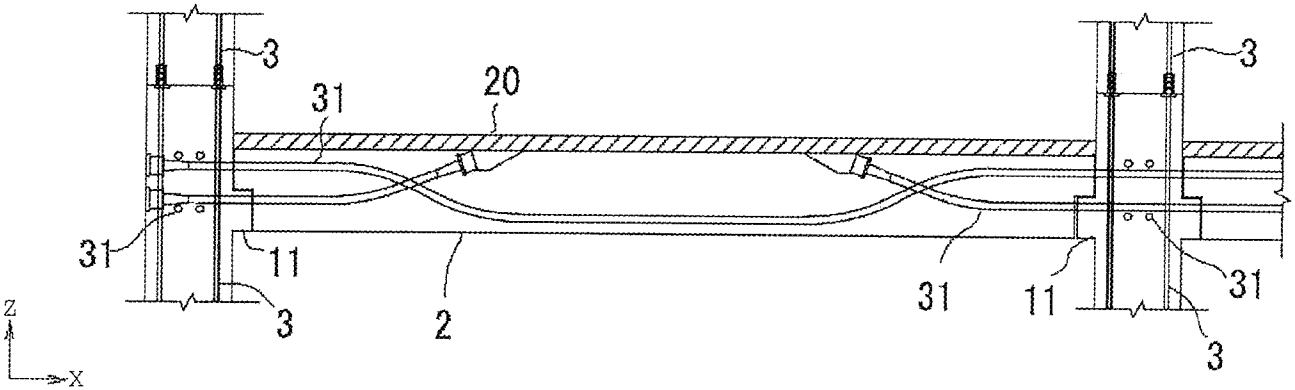

FIGS. 1A and 1B show a portion of a building to which the present invention is applied. FIGS. 1A and 1B are, respectively, a plan view and a side view of beam-column joints in a middle floor of a multi-story building.

PC columns 1 and PC beams 2 in the structure shown in FIGS. 1A and 1B are precast members. The PC columns 1 are set upright on the foundation (not shown). Prestressing steel rods 3 serving as prestressing tendons are passed through the PC column 1 and tensionally anchored (in other words, fixed in a tensioned state). The PC beams 2 are set on corbels 11 provided on the PC columns 1. Prestressing cables 31 provided in the PC beams 2 serving as prestressing tendons are passed through the beam-column joints and tensionally anchored.

As shown in FIGS. 1A and 1B, the prestressing steel rods 3 and the prestressing cables 31 serving as prestressing tendons are passed through the beam-column joint in two horizontal directions (X, Y) and the vertical direction (Z) and tensionally anchored to introduce prestress in the beam-column joint 10.

Components and features of the structure that are not directly relevant to the present invention are similar to those in conventional structures and will not be described in detail. For example, as in conventional structures, the PC columns and the PC beams are connected together using the prestressing tendons fixed in a tensioned state, and top concrete and a slab are formed on top of the precast PC beams to form composite beams.

The PC columns and the PC beams mentioned in the description of the present invention are prestressed concrete structural components.

Pressure connection of a precast PC column and a precast PC beam achieved only by prestressing tendons without the use of reinforcing bars will be referred to as full pressure connection, and connection achieved by both reinforcing bars and prestressing tendons will be referred to as semi pressure connection.

FIGS. 2A and 2B show the same structure in a plan view including the X and Y axes and a side view including the X and Z axes, respectively. In FIGS. 2A and 2B, to facilitate understanding of the present invention, the illustration of the prestressing tendons is eliminated, and prestresses o ($\sigma x$, $\sigma y$, $\sigma z$) acting on the beam-column joints are indicated by arrows to show that the beam-column joints 10 are in triaxial compression.

FIGS. 2C to 2E show the cross sectional shapes of the beams extending along the X axis and Y axis and the column extending along the Z axis at their end faces as a 2C-2C cross sectional view, a 2D-2D cross sectional view, and a 2E-2E cross sectional view respectively.

In the method according to the present invention, the operation of tensioning and anchoring secondary cables serving as prestressing tendons provided in the beam members and passed through the beam-column joints is performed before providing the top concrete 20. Therefore, the cross sectional areas Ax, Ay at the end of the beam do not include the top concrete 20. In other words, the cross sectional areas Ax, Ay at the end of the beams that will be used in calculation of the prestresses $\sigma x$, $\sigma y$ do not include the cross sectional area of the top concrete 20.

Similarly, the beam-column joint 10 (or panel zone) mentioned in the description of the present invention does not include the top concrete 20. In other words, the beam-column joint 10 refers to only the hatched portion in FIGS. 2A and 2B.

It is assumed that prestress $\sigma$ ($\sigma x$, $\sigma y$, $\sigma z$) is introduced only by tensioning of the prestressing tendons, and the influences of eccentricity of the centroid of the prestressing tendons in the cross sections of the beam members will be ignored.

Therefore, the prestress $\sigma$ ($\sigma x$, $\sigma y$, $\sigma z$) is calculated only by P/A, and influences of P·e are not taken into account, where P is the effective tension introducing force by the prestressing tendons, "A" is the cross sectional area (Ax, Ay, Az) at the end of each of the beam and the column member as described above, and "e" is the eccentricity of the centroid of the prestressing tendons from the centroid axis of the beam or column member in its cross section.

In this specification, the terms "PC column" and "PC beam" are used to refer to those which are prestressed over their entire length, which may include components that are prestressed by primary prestressing tendons (i.e. those prestressed in the factory) and components that are prestressed by secondary prestressing tendons (i.e. those prestressed at the site of construction).

The primary prestressing tendons are not illustrated in the drawings. Prestressing by primary prestressing tendons is conducted in the factory, and tensioning may be performed by either pre-tensioning or post tensioning. Tensioning of the secondary prestressing tendons is performed at the site of construction by post-tensioning. In the following description, prestressing cables used as secondary prestressing tendons will also be referred to as secondary cables.

Figure 3A:
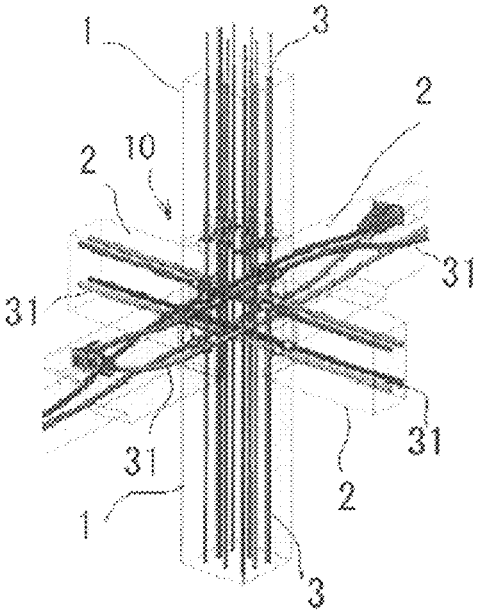
FIGS. 3A illustrates an arrangement of prestressing tendons in a beam-column joint.
Figure 3B:
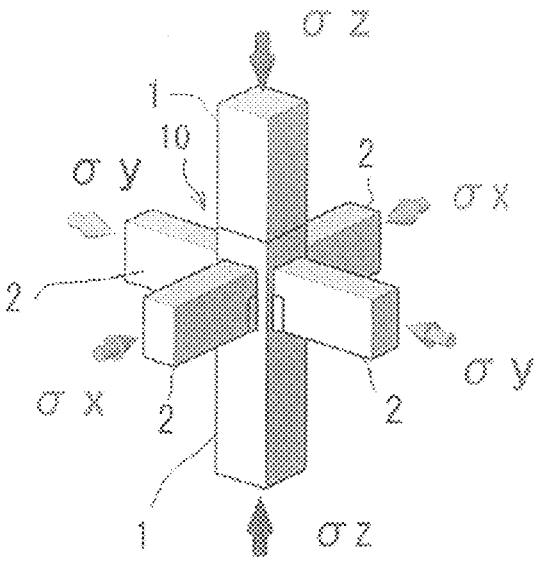
FIG. 3B illustrates directions of triaxial compressive stress on the beam-column joint.

FIGS. 3A and 3B show how prestress is introduced in the beam-column joint 10 in triaxial compression according to the present invention. FIG. 3A is a perspective view illustrating prestressing tendons set in the beam-column joint 10, and FIG. 3B is a view illustrating how triaxial compressive stress acts on the beam-column joint.

As shown in FIGS. 3A and 3B, in order to satisfactorily cancel diagonal tensile force generated due to the earthquake by establishing triaxial compression of the beam-column joint, it is necessary to introduce prestresses ($\sigma x$, $\sigma y$, $\sigma z$) in the beam-column joint 10 in three axial directions. Moreover, relationship among the introduced prestresses ($\sigma x$, $\sigma y$, $\sigma z$) is very important. Specifically, advantageous effects achieved by the constraint of the beam-column joint 10 is greatly affected by whether the prestresses ($\sigma x$, $\sigma y$, $\sigma z$) are in a well-balanced relationship.

Figure 4B:
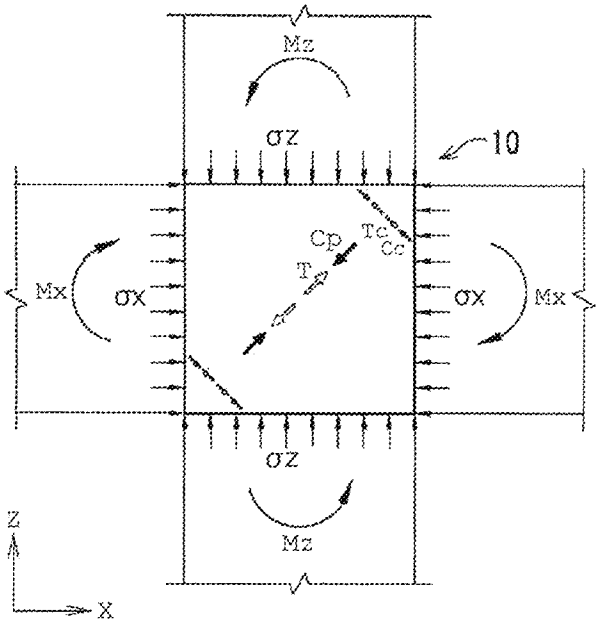
FIGS. 4A and 4B illustrate relationship between stresses in a beam-column joint and cracks occurring therein.
Figure 4A:
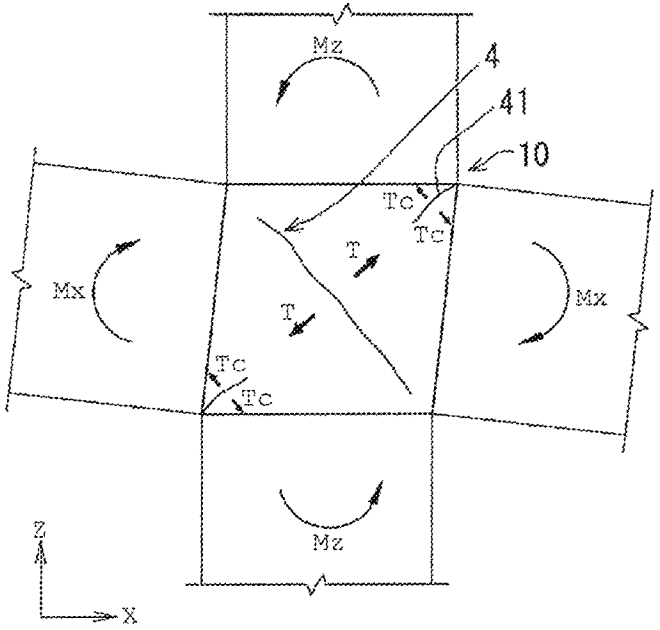

Advantageous effects of the present invention will now be described with reference to FIGS. 4A and 4B. FIGS. 4A and 4B illustrate relation between the stress in the beam-column joint 10 and the occurrence of cracks.

FIG. 4A shows a panel zone of a conventional RC construction on which a seismic load is acting on the building as a right action. Though not shown in the drawings, when a seismic load is acting on the building as a left action, the locations and directions of the stress, deformation, and cracks are reverse to those in FIG. 4A.

In the beam-column joint 10 of a conventional RC construction, when a great earthquake occurs, an input shear force (not shown) acts on the structural frame in the horizontal direction due to the seismic load, and the input shear force generates bending moments Mx and Mz on the ends of the beams and the columns respectively in the X-Z plane. On the column 1 is acting a vertical stationary load (N) as an axial force, the magnitude of which is not uniform but varies depending on the floor level. On the other hand, no axial force acts on the beam generally. Because constraint against the bending moments caused by the seismic load cannot be provided, there arises a relative displacement between the columns 1 on the vertically upper end and the lower end of the beam-column joint (or panel zone), and the ends of the horizontally left and right beams deform rotationally to make the beam-column joint 10 rhomboidal as shown in FIG. 4A. In consequence, the bending moments Mx, Mz acting on the ends of the beams and the columns generate a tensile stress on one side of the cross section of the beams and the columns and a compressive stress on the other side, though not shown. This tensile stress generates resultant diagonal tensile forces (T and Tc) along a diagonal and at corners of the beam-column joint, leading to the occurrence of cracks along the diagonals (including a diagonal crack 4 along the diagonal and diagonal cracks 41 at corners). This eventually causes a brittle shear failure, which probably leads to fatal collapse of the entire structural frame.

There may be cases where one of the diagonal crack 4 along the diagonal and the diagonal cracks 41 at corners occurs and cases where both of them occur. The occurrence of diagonal crack(s) along a diagonal mentioned in the description of the present application includes both the cases.

FIG. 4B shows a beam-column joint 10 in triaxial compression by prestress introduced according to the present invention. While FIG. 4B shows only the X-Z plane, the following description also applies to the Y-Z plane, though not shown in the drawings.

As shown in FIG. 4B, a seismic load tends to generate diagonal tensile forces in the beam-column joint (or panel zone) 10 including tensile forces T along a diagonal and tensile forces Tc at corners as in the above-described conventional structure. However, because the beam-column joint (or panel zone) 10 is strongly constrained from outside by virtue of the prestress $\sigma$ ($\sigma x$ and $\sigma z$ in FIG. 4B) introduced thereto, the beam-column joint 10 does not deform unlike with the conventional structure. Moreover, setting the ratio of prestresses as specified by equation (1) according to the present invention leads to a resultant compressive force Cp on a diagonal and resultant compressive forces Cc at corners. Furthermore, if the values of stresses $\sigma x$, $\sigma y$, and $\sigma z$ in equation (1) are limited within respective appropriate ranges, effective and favorable resultant compressive forces Cp and Cc will be generated to cancel the tensile forces T and Tc completely or partially, thereby preventing the occurrence of diagonal cracks.

There may be cases where the tensile force T on a diagonal is cancelled by the resultant compressive force Cp only partially and the tensile force T partly remains. According to the present invention, prestressing tendons are set and anchored in such a way as to introduce specific prestresses according to equation (1) so that the resultant compressive forces will make the tensile stress intensity (i.e. tensile stress per unit area) on a cross section of the concrete lower than the allowable tensile stress intensity of the concrete used to construct the beam-column joint, even if the tensile force T partly remains, thereby preventing diagonal cracks of concrete from occurring.

For example, if the design standard strength Fc of the concrete used to construct the beam-column joint 10 is $60N/mm^2$, the allowable tensile stress ft of the concrete is as follows: $ft=1/30Fc=2N/mm^2$. Prestress is introduced in such a way as to make a tensile stress intensity resulting from the aforementioned partially remaining tensile force T (if it remains) lower than the allowable tensile stress intensity of the concrete. This also applies to the tensile forces Tc occurring at corners.

In conventional PC structures constructed using precast PC columns and precast PC beams, a beam member and a column member are connected together by full pressure connection. Specifically, prestressing tendons passing through the column are tensionally anchored to the end of the beam. It is considered sufficient that the tension introducing force for this purpose be set in such a way as to meet requirements of PC pressure connection of the end of the beam to the column. Likewise, in conventional PC structures, to connect two column members together by PC pressure connection, prestressing tendons are arranged along the axial direction of the columns and required prestressing force is introduced.

In conventional structures, no consideration has been given to relationship between the prestressing in the X and Z directions or Y and Z directions for the purpose of generating a resultant compressive force Cp on a diagonal of the beam-column joint (or panel zone). In other words, in conventional structures, stress introducing forces in the respective directions have been applied only for the purpose of achieving full pressure connection of the members, but no consideration has been given to the ratio among the magnitudes of the stress introducing forces. Therefore, it is not secured that an effective resultant compressive force Cp is always generated on a diagonal of the beam-column joint (or panel zone). Likewise, no consideration has been given to generation of compressive forces at corners of the beam-column joint (or panel zone).

Figure 5A:
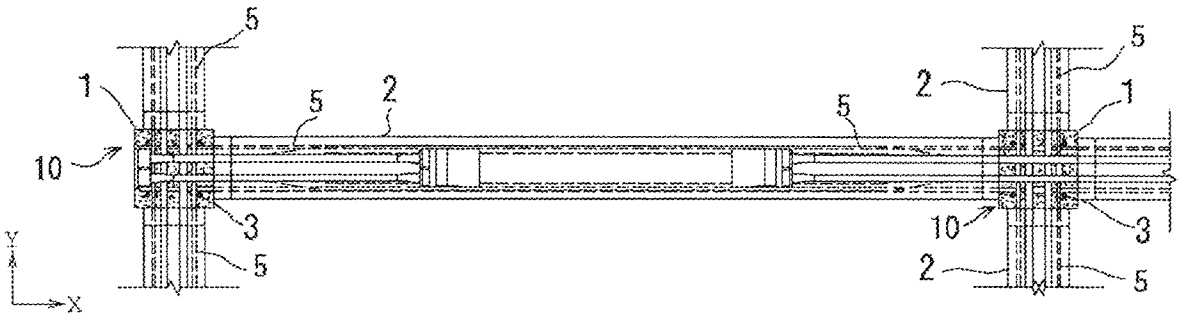
FIGS. 5A to 5C show a semi pressure contact PC structure including a beam-column joint formed by cast-in-situ concrete.
Figure 5B:
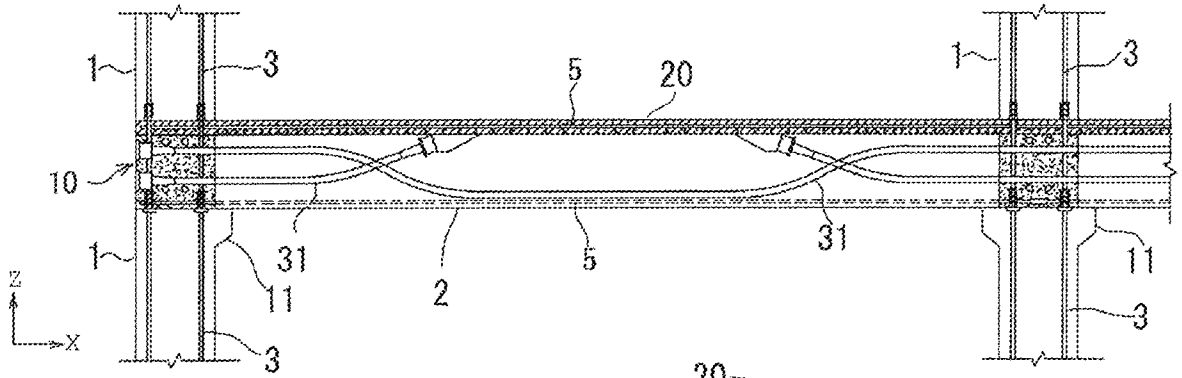
Figure 5C:
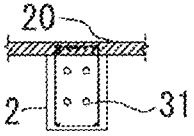

FIGS. 5A to 5C show a case where a PC structure is constructed by layered construction. In this case, columns and beams are prepared as precast members, and beam-column joints (or panel zones) 10 are constructed by concrete cast in situ. Precast beam members may be joined together by fixing reinforcing bars extending from the precast beam members to a beam-column joint. Regarding precast column members, though not shown in the drawings, reinforcing bars extending from a precast column member are extended through a beam-column joint, so that the upper precast column member may be connected with another precast column member, using a mortar-filled joint or the like in some cases, as shown in FIG. 5 of Patent Literature 3 (Japanese Patent No. 4041828). In such cases, while the beam members and the column members are made of PC structure, the beam-column joints 10 are made of RC structure.

In some conventional layered constructions, the amount of reinforcing bars is reduced to provide prestressing tendons, and tension introducing forces are applied. In such cases, connections of members are achieved by semi pressure connection instead of full pressure connection, leading to a much smaller number of prestressing tendons required than in full pressure connection. Hence, the prestress introduced in the beam-column joint is much lower. Therefore, in layered constructions, it is not possible to generate effective resultant compressive forces (Cp and Cc) in beam-column joints (or panel zone) 10.

In PC structures constructed by the conventional layered construction, beam-column joints are made of RC (reinforced concrete) or PRC (prestressed reinforced concrete), which are more vulnerable to diagonal cracking than ordinary beam-column joints made of PC. Therefore, the need for reinforcement by prestressing is higher in structures using semi pressure connection than in structures using full pressure connection.

In the method according to the present invention, prestressing tendons are arranged along three axial directions (X, Y, Z) in a beam-column joint as in conventional methods. Moreover, the present invention definitely teaches a specific method of introducing prestresses with a reduced prestress $\sigma z$ along the vertical direction, which is determined taking account of axial force acting on the column. Specifically, appropriate prestresses are introduced according to equation (1). Moreover, the present invention limits numerical ranges for the values of prestresses $\sigma x$, $\sigma y$, and $\sigma z$ that are suitable for the design standard strength of concretes commonly used in PC structures such that effective resultant compressive forces (Cp and Cc) that are not too large nor too small will be generated in the beam-column joint(or panel zone).

The process of layered construction according to an embodiment of the present invention, shown in FIGS. 5A to 5C will now be described.

Firstly, precast PC columns 1 are set upright on the foundation (not shown), and prestressing steel rods 3 serving as prestressing tendons are passed through the PC columns 1 and tensionally anchored. Then, precast PC beams 2 are set on corbels 11 provided on the PC columns 1, and bottom reinforcing bars 5 extending from ends of adjacent PC beams 2 are connected by reinforcing bar joints. The bottom reinforcing bars 5 may be connected by lap joint without using reinforcing bar joints, alternatively. Then, wires and reinforcing bars are arranged in the beam-column joints (or panel zones) 10, and concrete having a compression strength equal to or higher than the PC beams 2 is poured in situ up to the level as high as the upper face of the precast PC beams 2 and cured. After the concrete is cured, prestressing cables 31 serving as prestressing tendons arranged in the PC beams 2 are tensionally anchored to introduce prestress in two horizontal directions (X, Y). Then, upper top reinforcing bars 5 are set on top of the precast PC beams 2, and top concrete and a slab are formed together. Normally, the concrete of the PC beams 2 and the slab have different strength, specifically the PC beams 2 have higher strength. Therefore, cast-in-situ concrete in the beam-column joint (or panel zone) 10 is poured and cured in two stages.

After the top concrete 20 is cured, a precast PC column 1 of the upper floor is set on the beam-column joint 10, and prestressing steel rods 3 serving as prestressing tendons are connected by couplers and tensionally anchored to introduce prestress in the vertical direction (or Z direction). When reinforcing bars extend into the PC column 1 of the upper floor, the reinforcing bars are passed through the beam-column joint before pouring concrete, and after the concrete is poured and cured, the reinforcing bars are connected with the column member of the upper floor by connecting the reinforcing bars by mortar-filled joints.

In the case of the beam-column joint (or panel zone) 10 constructed by layered construction described above, the cross sectional area Ax, Ay at the end of the beam does not include the top concrete, as with the embodiment shown in FIGS. 1A and 1B, where all the components used are precast members. Therefore, relationship represented by equation (1) applies to this case also.

The method of introducing prestress in a beam-column joint according to the present invention can also be applied to PC structures constructed by cast-in-situ prestressed concrete in which all of the PC columns, PC beams, and beam-column joints (panel zone) 10 are constructed by concrete that is cast in situ, though not shown in the drawings.

In this case, the cross sectional area Ax, Ay at the end of the beam shall be construed as the cross sectional area at the time when prestressing tendons are tensionally anchored to introduce prestress. For example, in cases where the slab has not been formed on the beam at the time of tensional anchoring, the cross sectional area Ax, Ay shall be construed not to include the slab. In cases where tensional anchoring is performed after the beam and the slab are formed, the cross sectional area Ax, Ay shall be construed to include the slab.

In a mode of the present invention, at least five layers (or stories) of a building are grouped, and the same prestress is introduced in the beam-column joints in the same group of layers. This mode will be described in the following.

The axial force acting on columns varies depending on layers (or floor levels) of the building. Therefore, it is preferable that the prestress introduced in the columns be adjusted according to the variations in the axial force to uniformize the sum of the axial force and the prestress. However, controlling the tension is a very troublesome and difficult task. In this mode of the present invention, an allowable range ($\sigma z$=0.3–0.9) is set for the ratio of the stress introduced in the columns to the stress introduced in the beams, to allow the same stress to be set for the columns in five layers in the same group. This facilitates the design and construction of the beam-column joints.

For example, in a ten-story building of PC structure, a certain number of prestressing steel rods are provided in each column in the first to fifth floors. Because the axial force decreases in the columns in the sixth to tenth floors, the number of prestressing steel rods provided in each column in the sixth to tenth floors is increased to compensate the decrease accordingly. This mode provides a practical method of introducing prestress that allows the sum of the axial force and the prestress acting on columns in these layers to readily fall within the allowable range ($\sigma z$=0.3–0.9) while enabling simplification in design and construction of the building.

An extremely great earthquake is so rare as to occurs once in the lifetime of a building at most. Even if it occurs, the building will not be significantly damaged unless diagonal cracks occur. Therefore, in the present invention, when a part of the diagonal tensile force generated at the beam-column joint remains, the tensile stress intensity may be set to be equal to or less than the allowable tensile stress of concrete. This is applied when priority is given to reducing construction costs by reducing PC tendons.

REFERENCE SINGS LIST

1: PC column
10: beam-column joint (or panel zone)
11: corbel
2: PC beam
20: top concrete
3: prestressing steel rod
31: prestressing cable
4: diagonal crack
41: diagonal crack at corner
5: reinforcing bar
T: tensile force
Tc: tensile force
Cp: resultant compressive force
Cc: resultant compressive force at corner

What is claimed is:

1. A method of introducing prestress in a beam-column joint that introduces prestress in a beam-column joint in a multi-story building structure constructed by prestressed concrete (PC) columns and prestressed concrete (PC) beams with a tensile introducing force generated by tensionally anchoring prestressing tendons that are arranged in the PC beams extending along two horizontal directions (or X axis and Y axis) and the PC columns extending along a vertical direction (or Z axis) and passed through the beam-column joint to bring the beam-column joint in triaxial compression, the prestress being introduced such that a diagonal tensile force generated by an input shear force due to a seismic load of an extremely great earthquake that may occur very rarely will be cancelled completely or partially so as not to allow diagonal cracks to occur, wherein the ratio of the prestresses introduced in the directions of the respective axes satisfies the following equation (1):

$$\sigma x:\sigma y:\sigma z=1:1:0.3\text{-}0.9 \quad (1)$$

where $\sigma x$, $\sigma y$, and $\sigma z$ are prestresses introduced in the directions of the X axis, the Y axis, and the Z axis respectively, which are calculated by the following equations:

$$\sigma x=Px/Ax,\ \sigma y=Py/Ay,\ \sigma z=Pz/Az,$$

where Px is the tensile introducing force in the direction of the X axis, Ax is a cross sectional area of the beam at an end with respect to the X axis, Py is the tensile introducing force in the Y axis, Ay is a cross sectional area of the beam at an end with respect to the Y axis, Pz is the tensile introducing force in the Z axis, and Az is a cross sectional area of the column at an end with respect to the Z axis.

2. A method of introducing prestress in a beam-column joint according to claim 1, wherein values of $\sigma x$, $\sigma y$ and $\sigma z$ fall within the following ranges:

$2.0 \le \sigma x \le 10.0$ (N/mm$^2$)
$2.0 \le \sigma y \le 10.0$ (N/mm$^2$)
$0.6 \le \sigma z \le 9.0$ (N/mm$^2$).

3. A method of introducing prestress in a beam-column joint according to claim 2, wherein at least five layers of the building structure are grouped, and the prestress $\sigma z$ introduced in PC columns in the layers of a same group is uniformized.

4. A method of introducing prestress in a beam-column joint according to claim 3, wherein the prestress is introduced such that when a diagonal tensile force generated in the beam-column joint by the extremely great earthquake is partly cancelled and partly remains, a tensile stress intensity resulting from the remaining diagonal tensile force will be equal to or lower than an allowable tensile stress of the prestressed concrete in the beam-column joint.

5. A method of introducing prestress in a beam-column joint according to claim 2, wherein the prestress is introduced such that when a diagonal tensile force generated in the beam-column joint by the extremely great earthquake is partly cancelled and partly remains, a tensile stress intensity resulting from the remaining diagonal tensile force will be equal to or lower than an allowable tensile stress of the prestressed concrete in the beam-column joint.

6. A method of introducing prestress in a beam-column joint according to claim 1, wherein the prestress is introduced such that when a diagonal tensile force generated in the beam-column joint by the extremely great earthquake is partly cancelled and partly remains, a tensile stress intensity resulting from the remaining diagonal tensile force will be equal to or lower than an allowable tensile stress of the prestressed concrete in the beam-column joint.

* * * * *